US007207076B2

(12) United States Patent
Gardner

(10) Patent No.: US 7,207,076 B2
(45) Date of Patent: Apr. 24, 2007

(54) FOLDING BUNK BED

(75) Inventor: Steward E. Gardner, Bristol, IN (US)

(73) Assignee: R-N-R International, Inc., Bristol, IN (US)

( * ) Notice: Subject to any disclaimer, the term of this patent is extended or adjusted under 35 U.S.C. 154(b) by 0 days.

(21) Appl. No.: 11/084,428

(22) Filed: Mar. 18, 2005

(65) Prior Publication Data

US 2005/0217021 A1 Oct. 6, 2005

Related U.S. Application Data

(60) Provisional application No. 60/554,946, filed on Mar. 22, 2004.

(51) Int. Cl.
*A47C 17/00* (2006.01)

(52) U.S. Cl. ..... 5/9.1; 5/118

(58) Field of Classification Search ..... 5/9.1, 5/118, 136, 141, 147; 296/174
See application file for complete search history.

(56) References Cited

U.S. PATENT DOCUMENTS 622,993 A * 4/1899 Chamberlain ..... 5/9.1
6,663,173 B1 * 12/2003 Corfitsen ..... 297/62

* cited by examiner

*Primary Examiner*—Patricia Engle
*Assistant Examiner*—Fredrick Conley
(74) *Attorney, Agent, or Firm*—R. Tracy Crump

(57) ABSTRACT

The folding bunk beds of this invention fold between a horizontal sleep position and a vertical storage position. The various embodiments, both manually operated and power operated, of the folding bunk beds use vertically shifting pivot points to accommodate larger bed decks. The bed decks are hinged to carriages that slide on vertical shafts mounted within a wall frame. Bed decks are mounted to support arms that are pivotally connected to the carriages. A linkage mechanism or guide track allows the bed decks to pivot simultaneously between a horizontal sleep position and a vertical storage position as the carriages shift along the shafts. The vertically shifting pivot point allows the bed decks to kneel down, that is to fold up at a pivot point lower on the wall.

20 Claims, 20 Drawing Sheets

10
20
36
34
32
44
40
50
30
23
48
22
46
28
40
32
34
52
25

10
20
36
22
23
44
40
34
32
48
50
30
46
28
25
32
40
52
34

70
74
78
78
76

FOLDING BUNK BED

This application claims priority based upon Provisional Application Ser. No. 60/554,946 filed Mar. 22, 2004 now abandoned.

This invention relates to bunk beds and particularly folding bunk beds that pivot between a horizontal sleep position and a vertical storage position.

BACKGROUND OF THE INVENTION

Bunk beds are commonly used in applications where living space is limited, such as in small apartments and recreational vehicles. To further utilize living space in such applications, bunk beds often have sleeping decks that are hinged to the wall so that they can be pivoted into a storage position when not used. Folding bunk beds have been developed that are both manually and automatically operated. While popular for utilizing available living space, conventional manual and automatic folding bunk beds have several practical shortcomings.

Heretofore, the bed decks are hinged to the wall or a wall mounted frame at a fixed point, which limits the size of the bed decks to the height of the space above the decks. In a recreational vehicle application, where ceiling heights are relatively low, bed decks typically are limited to twin bed sizes. Consequently, a folding bunk bed that can accommodate larger bed decks is still desirable.

Furthermore, cables are used to support the bed decks in both manual and automatic folding bed decks. In automatic folding bunk beds, the cables are wound to winches that actuate the bed deck between their sleep and storage positions. Cable lengths and tensions must be matched precisely to ensure that the bed decks are level. Cable slack, binding and unspooling are frequent problems that seriously detract from the operation of cable actuated folding bunk beds. A more compact, safe and reliable automatic folding bunk bed is still desirable, particularly for applications where space and height is limited.

SUMMARY OF THE INVENTION

The various embodiments, both manually operated and power operated, of the folding bunk beds of this invention use a vertically shifting pivot point to accommodate larger bed decks. The bed decks are hinged to carriages that slide on vertically mounted shaft (a smooth rod for manually operated embodiments and a threaded screw shaft for power operated embodiments) within a wall frame. Bed decks are mounted to support arms that are pivotally connected to the carriages. A linkage mechanism or guide track allows the bed decks to pivot simultaneously between a horizontal sleep position and a vertical storage position as the carriages shift along the shafts. The vertically shifting pivot point allows the bed decks to kneel down, that is to fold up at a pivot point lower on the wall. The shifting pivot point not only accommodates larger bed decks and eliminates the problems associated with cable supports, but allows bed decks to overlap in the storage position.

Accordingly, the bunk beds of this invention have several advantages over conventional folding bunk beds. In particular, the bunk beds of this invention accommodate larger bed decks.

Another advantage is that the bed decks can be overlapped in the storage position, which allows a lower bed deck limited only by ceiling height.

Another advantage is that the screw shaft actuation mechanism is more reliable than cable actuated mechanisms and does not require complex mechanical adjustments.

Another advantage is that the actuation mechanism is enclosed entirely within the wall frame, which reduces unsightly cable and reduces possible safety hazards.

Another advantage is that the mattress and bedding can be stored on the bed decks when the bunk beds are in the vertical storage positions.

Other advantages will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

Figure 1:
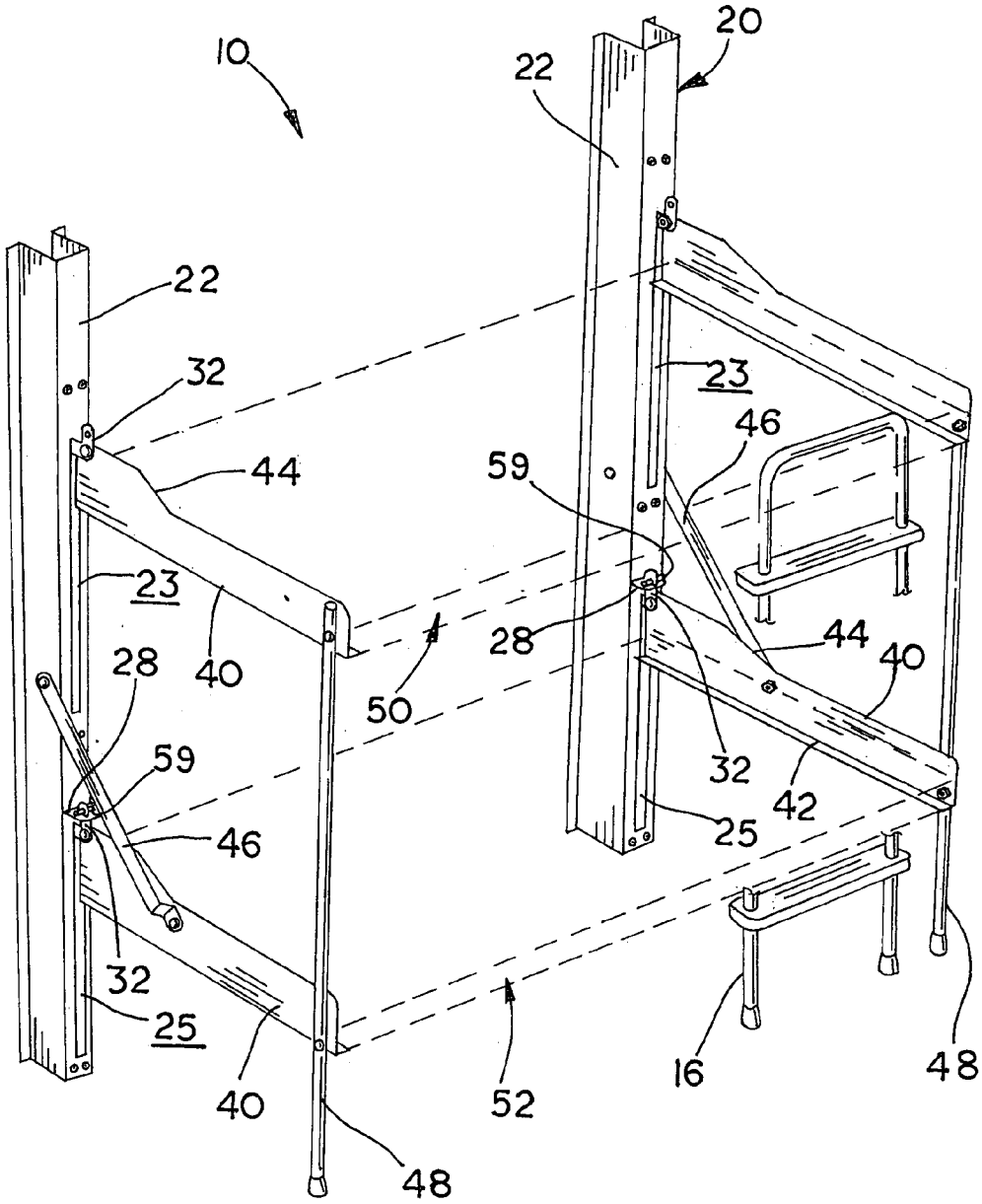
FIG. 1 is a perspective view of the first (manually operated) embodiment of the bunk bed of this invention with portions of the bed decks cut away.
Figure 2:
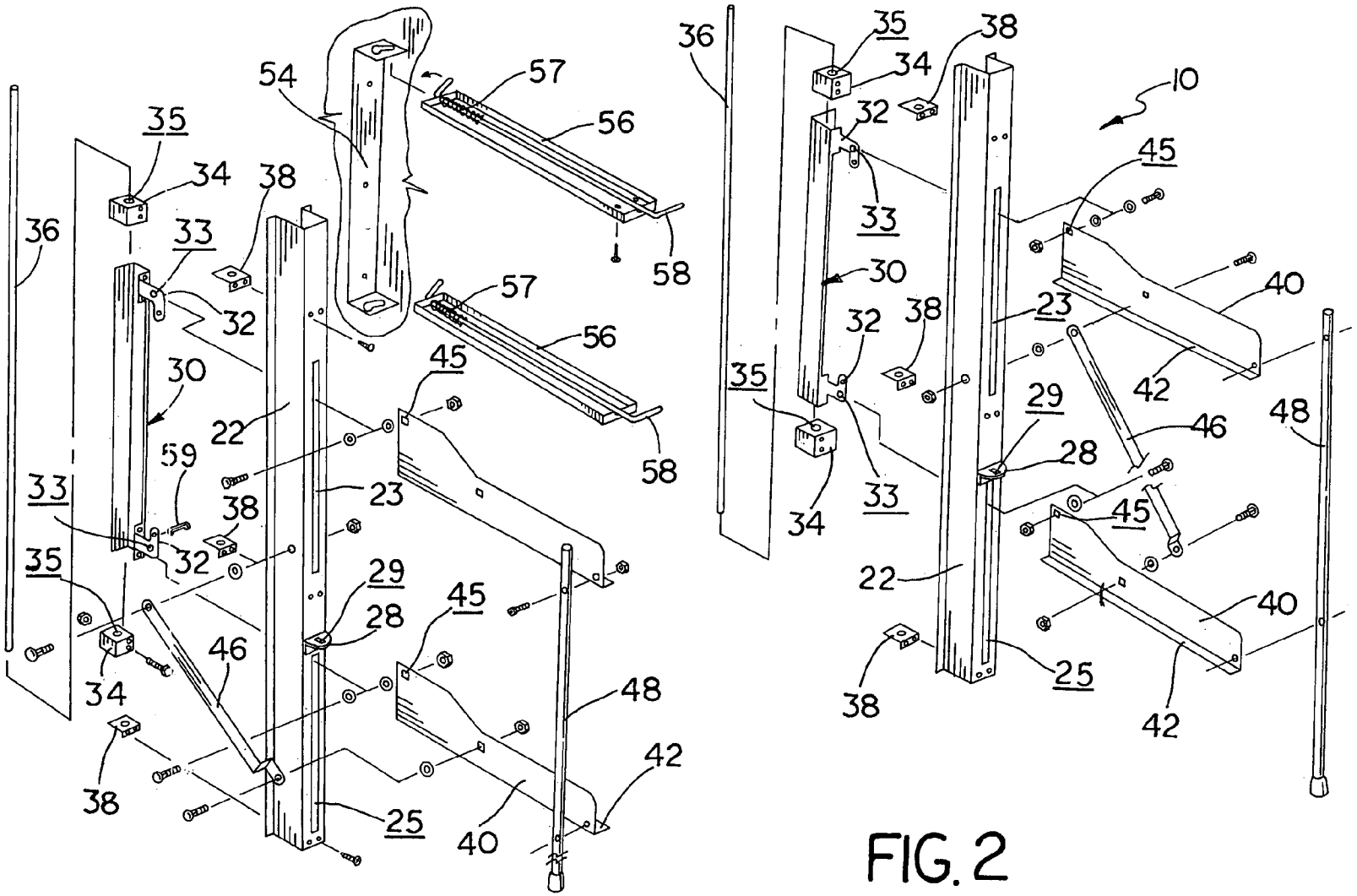
FIG. 2 is an exploded view of the first embodiment of the bunk bed.

The preferred embodiments herein described are not intended to be exhaustive or to limit the invention to the precise form disclosed. They are chosen and described to best explain the invention so that others skilled in the art might utilize its teachings. The figures illustrate two different embodiments of the bunk bed of this invention. Both embodiments of this invention are intended for use in applications where living space is limited or confined, such as in recreational vehicles.

First Embodiment—Manually Folding Bunk Bed

FIGS. 1–7 illustrate the first manually operated embodiment of the bunk bed of this invention, which is designated generally as reference numeral 10. Bunk bed 10 includes a wall frame 20, which is secured to a vertical wall, a pair of carriages 30 shiftably mounted on shafts 36 vertically disposed within the wall frame, and a pair of bed decks (upper deck 50 and lower deck 52) pivotally connected to the carriages.

Wall frame 20 secures bunk bed 10 to the interior walls of a structure or vehicle and provide the structural supports for the bunk bed. Wall frame 20 is mountable to an interior wall of a house or recreational vehicle (not shown) using screws, bolts, adhesive or other suitable methods well known in the arts. Wall frame 20 includes a pair of uprights 22, which are constructed of a section of metal U-channel. As shown, each upright 22 has two elongated longitudinal slots (upper 23 and lower 25). A long shaft 36 is vertically disposed within each upright 22. Shaft 36 is a steel rod that is secured within the upright by brackets 38.

Carriage 30 is a section of metal channel having a cross section generally configured to shiftably conform to the interior of uprights 22. Carriage 30 has an L-shaped tab 32 that is bent or formed to protrude from opposite ends of the carriages. Two bearing blocks 34 are seated at opposite ends of the carriages. Bearing blocks 34 are constructed of a plastic, nylon, teflon or similar low friction material. Bearing blocks 34 have central bores 35 through which shaft 36 extends. As shown, carriages 30 are shiftably disposed within upright 22, so that L-tab 32 extends through upright slots 23 and 25. The low friction properties of bearing blocks 34 allow them to slide freely along rod 36 so that L-tabs 32 move between the ends of upright slots 23 and 25.

Bed decks 50 and 52 are flat sheets of laminated wood, fiberboard or other suitable material, which support the mattress and bedding. Bed decks 50 and 52 are pivotally connected to carriages 30 by support arms 40. Deck support arms 40 are long metal brackets that have a horizontal flange 42 extending along theirs bottom edge upon which bed decks 40 and 42 are secured. Each support arm 40 also has a joggle 44 along their upper edge such that the proximal end of the arm is wider than the distal end. Deck support arms 40 have a lateral through bore 55 in the upper corner of their proximal end. Deck support arms 40 are pivotally connected to carriages 30 by fasteners (a bolt and nut), which extend through bores 45 and through bores 33 in L-tabs 32. A linkage 46, which is a long metal strap, is pivotally connected to uprights 22 and deck support arms 40 of lower deck 52. Linkage 46 is pivotally connected at one end to a central point of deck support arm 40 and at the other end to the side of uprights 22. Upper and lower bed decks 40 and 42 are pivotally connected by a pair of long bed posts 62, which support the outer edge of the bed decks when in the horizontal sleep position. Bed posts 48 are hinged to brackets mounted to bed decks 50 and 52 so that the post supports the bed decks in the sleep position and folds with the bed decks in the storage position. Bed decks 50 and 52 also include a bottom support plate 56, which helps support the decks in the sleep position. Support plates 56 have a spring loaded lock bar 58, which is used with a wall mounted lock bracket 54 to secure the bed decks in the horizontal sleep position.

Figure 3:
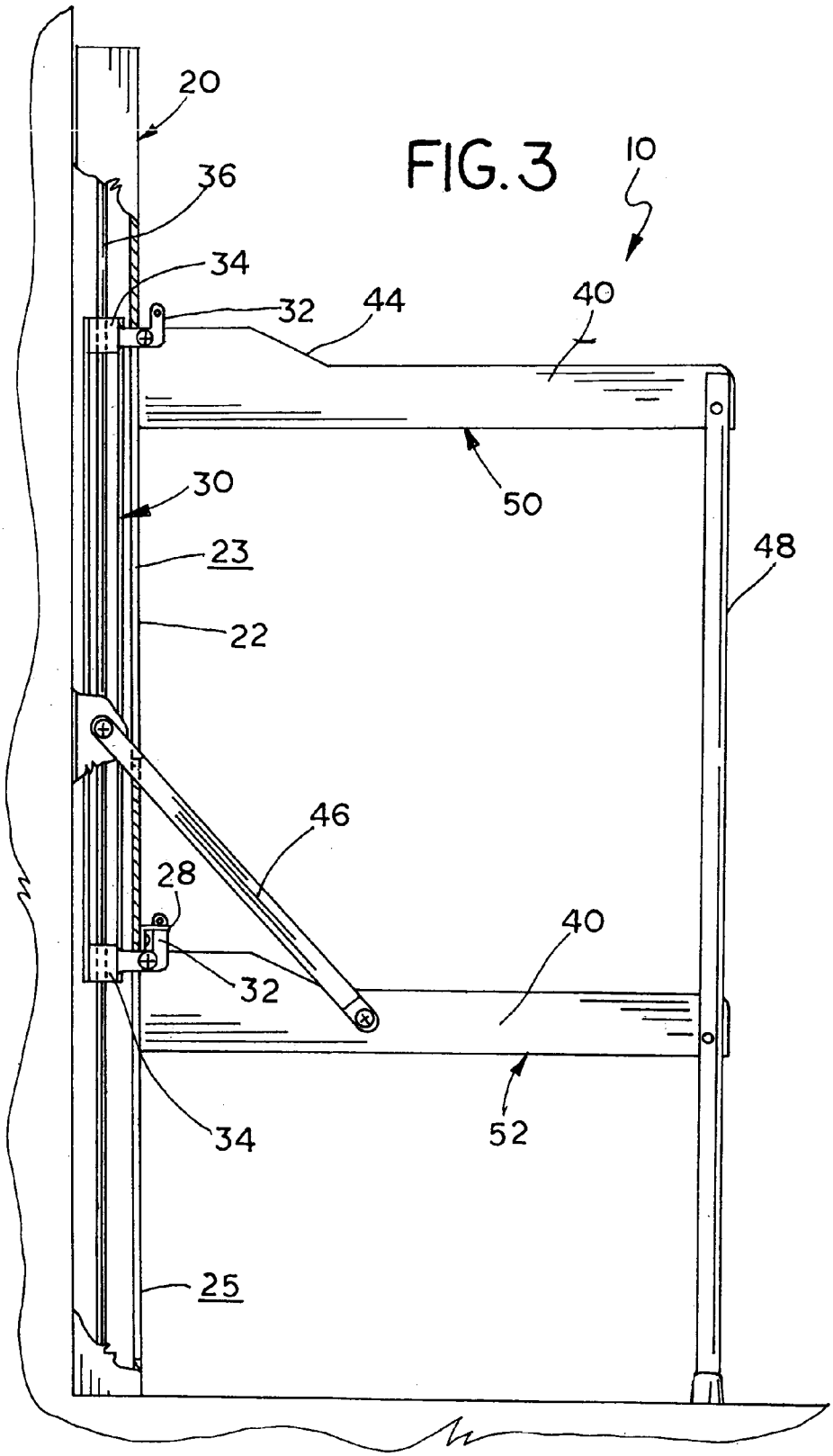
FIG. 3 is a side plan view of the first embodiment of the bunk bed in the horizontal sleep position.
Figure 4:
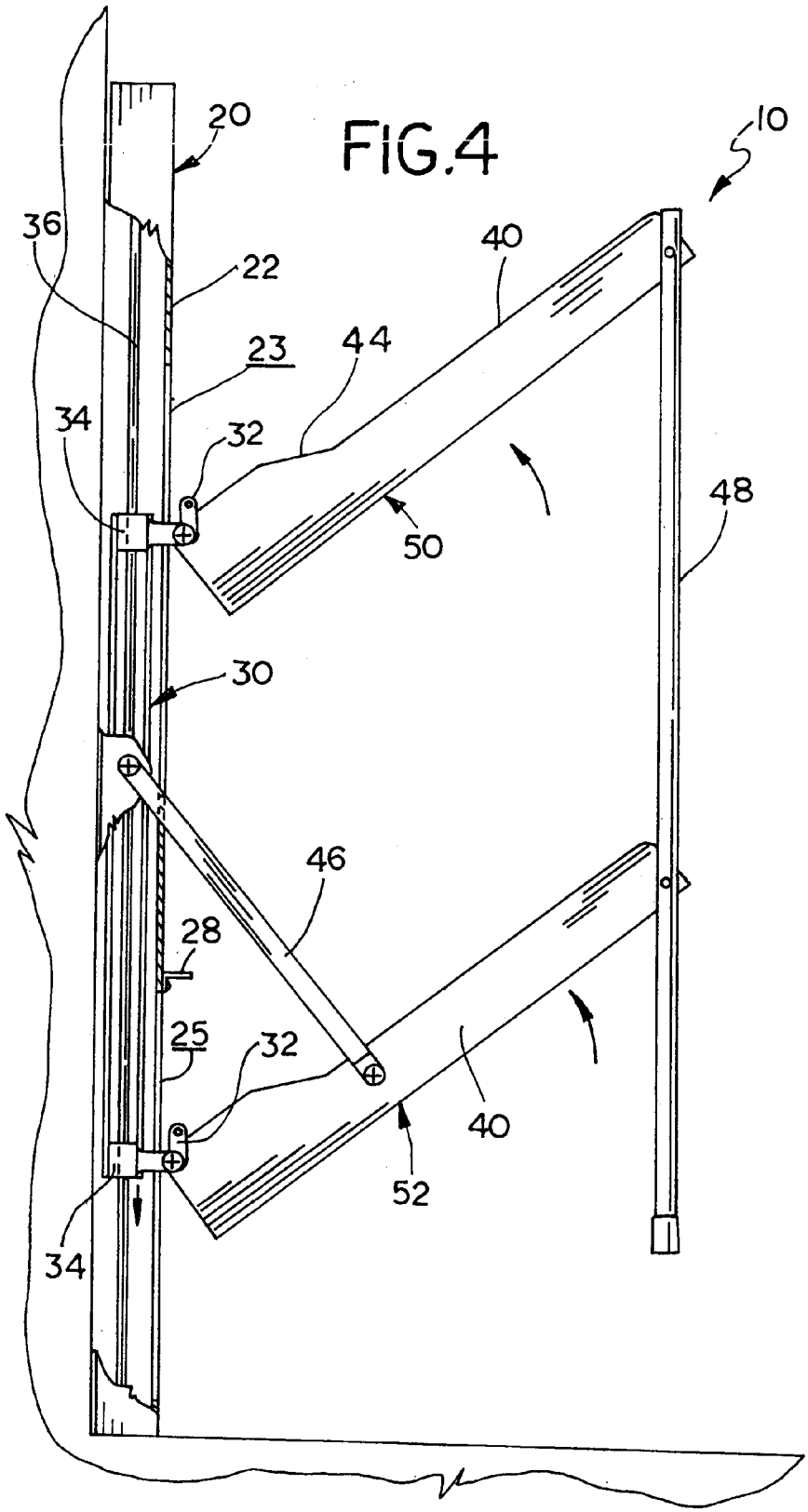
FIG. 4 is a side plan view of the first embodiment of the bunk bed pivoting from the horizontal sleep position to the vertical storage position.
Figure 5:
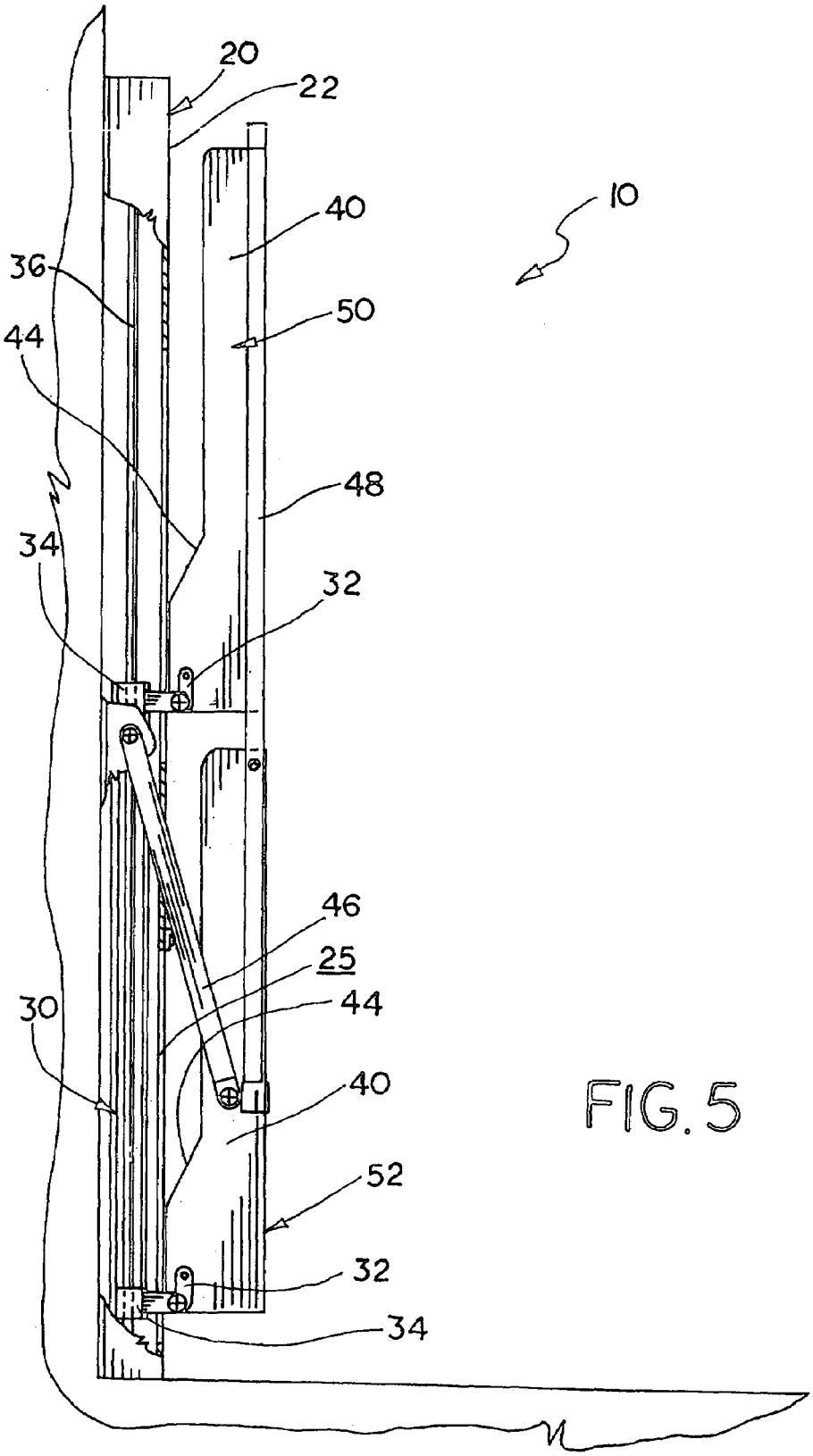
FIG. 5 is a side plan view of the first embodiment of the bunk bed in the vertical storage position.
Figure 6:
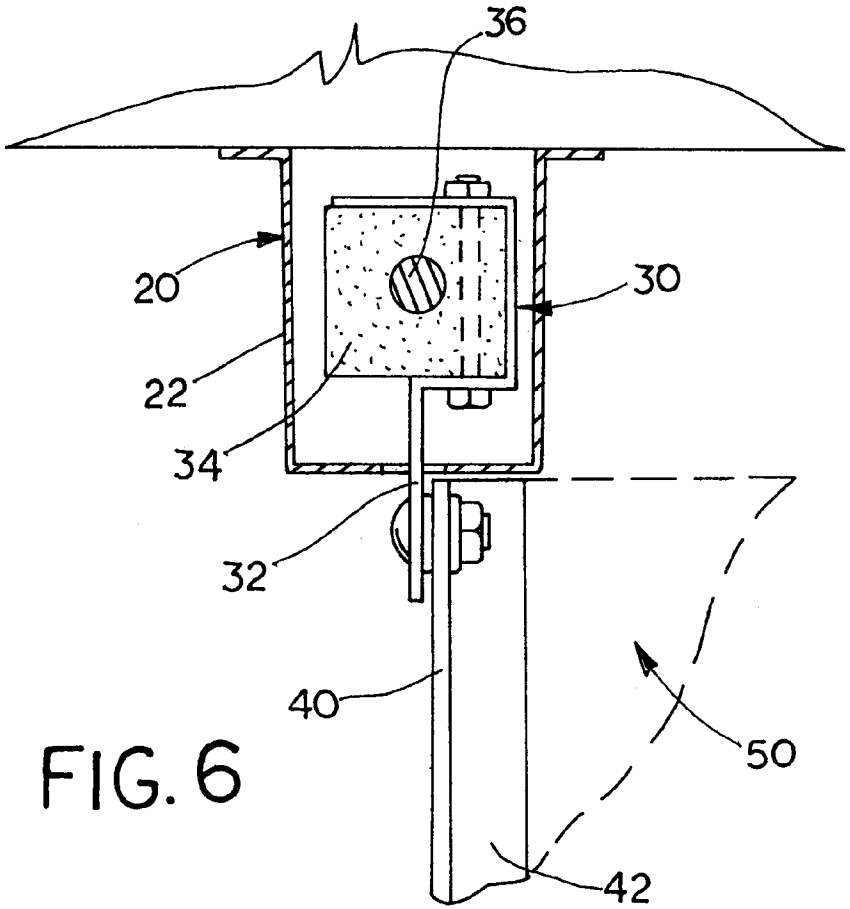
FIG. 6 is a partial top sectional view of the upright, carriage, rod, deck arm support and bed deck.
Figure 7:
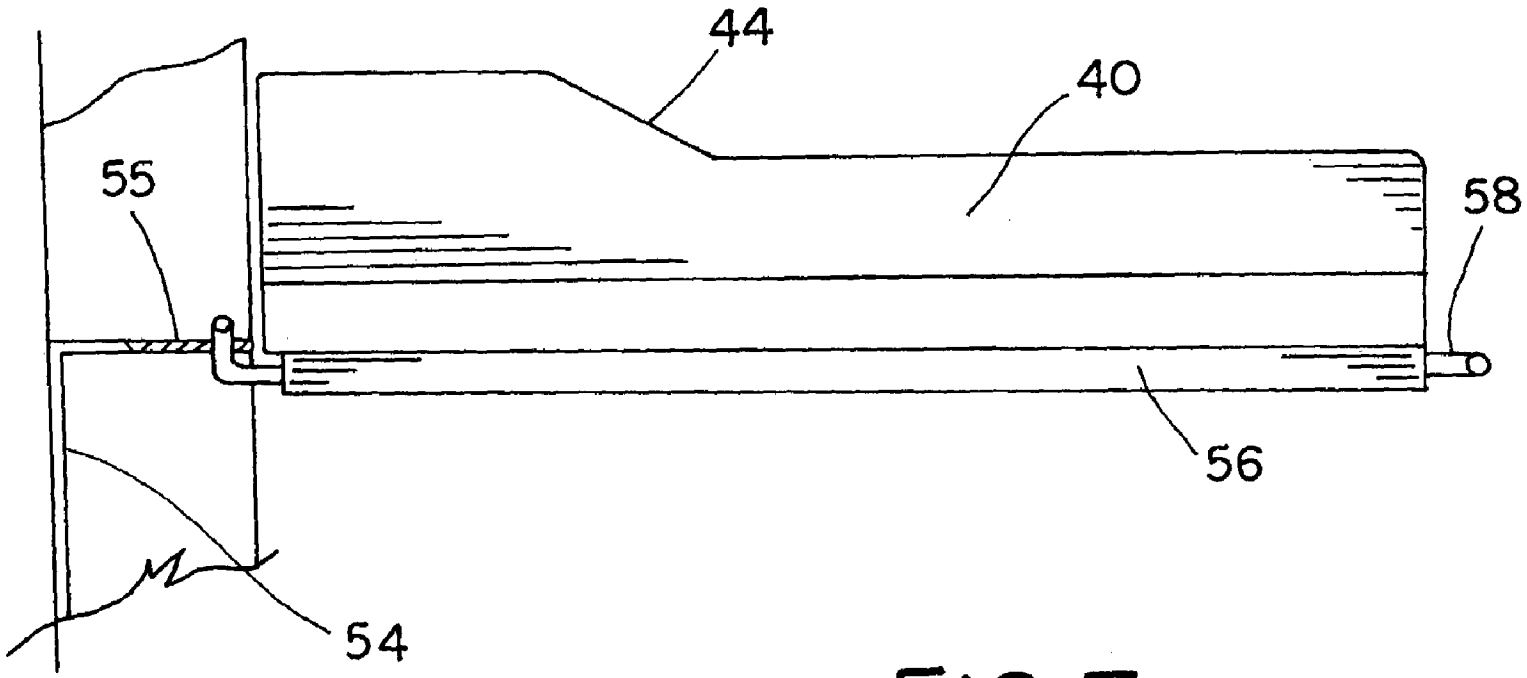
FIG. 7 is side sectional view of the deck support plate, lock bar and lock bracket.

As shown in FIGS. 3–5, bunk bed 10 is manually moved between a horizontal sleep position where bed decks 50 and 52 extend perpendicularly from wall frame 20 (FIG. 3) and a vertical storage position where bed decks 50 and 52 lie parallel to wall frame 20 (FIG. 5). The reciprocal movement of carriage 30 up and down shaft 36 within uprights 22 pivots bed decks 50 and 52 between the sleep and storage positions. As carriage 30 moves along shaft 36, linkage 46 and bed post 48 cause both bed decks 50 and 52 to simultaneously pivot between the sleep and storage positions. In the vertical storage position, carriage 30 is shifted along shaft 36 so that L-tabs 32 rest at the bottom of upright slots 23 and 25. Bed posts 47 and linkage 46 also fold up to lie parallel to wall frame 20. In the horizontal sleep position, carriage 30 is positioned on shaft 36 so that L-tabs 32 abut against the top of upright slots 23 and 25 so that the lower L-tab 32 extends though slot 29 in stop bracket 28. As shown in FIG. 7, lock bar 58 is turned to engage lock bracket 54 once in the sleep position. In addition, a snap ring or cotter pin 59 can be inserted through the bore in the lower L-tab 32 to lock the bed decks in the horizontal position.

Second Embodiment—Manual Folding Overlapping Bunk Bed

Figure 8:
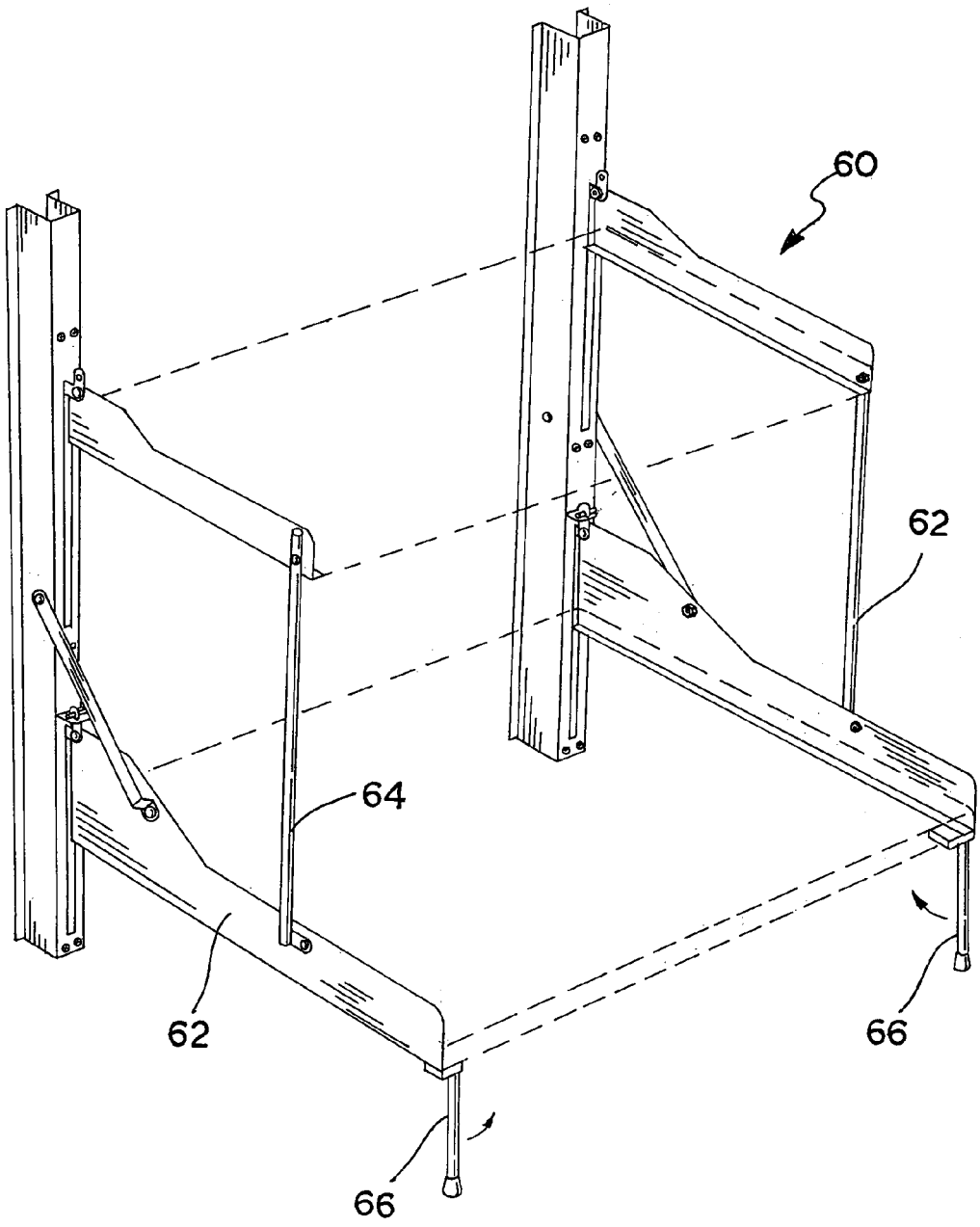
FIG. 8 is a perspective view of a second (manually operated) embodiment of the bunk bed of this invention with portions of the bed decks cut away.
Figure 9:
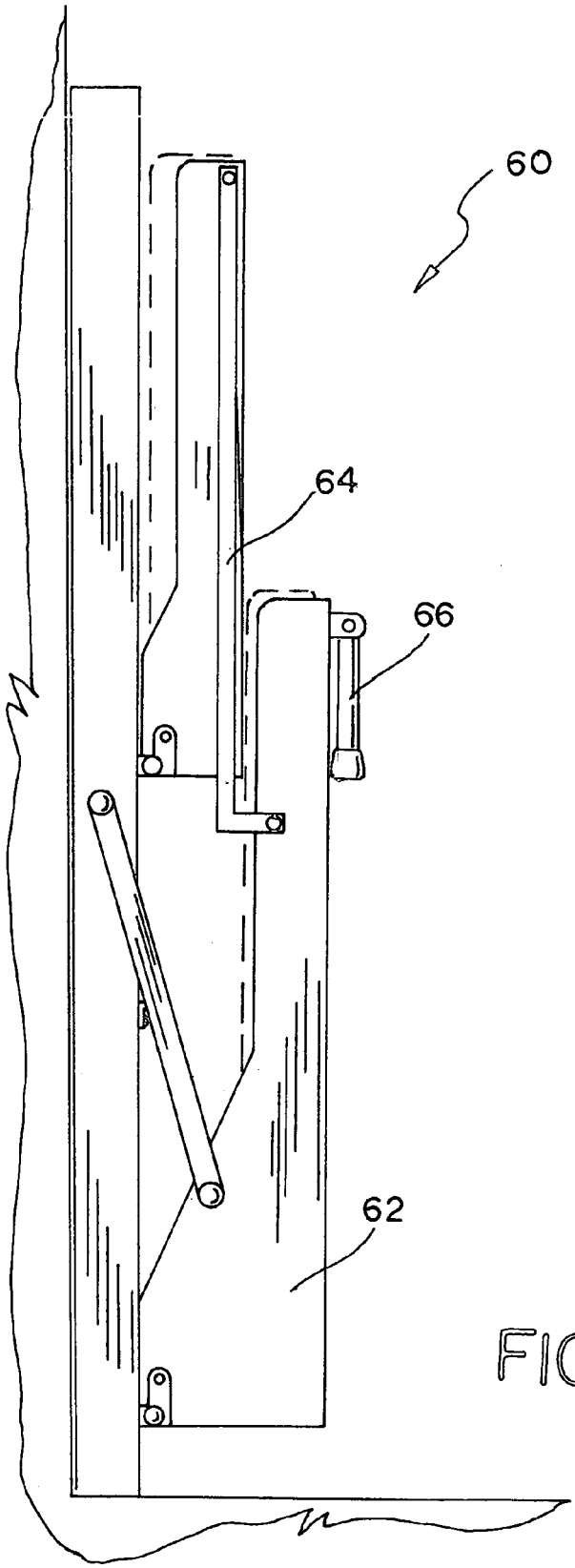
FIG. 9 is a side plan view of the second embodiment of the bunk bed in the vertical storage position.
Figure 10:
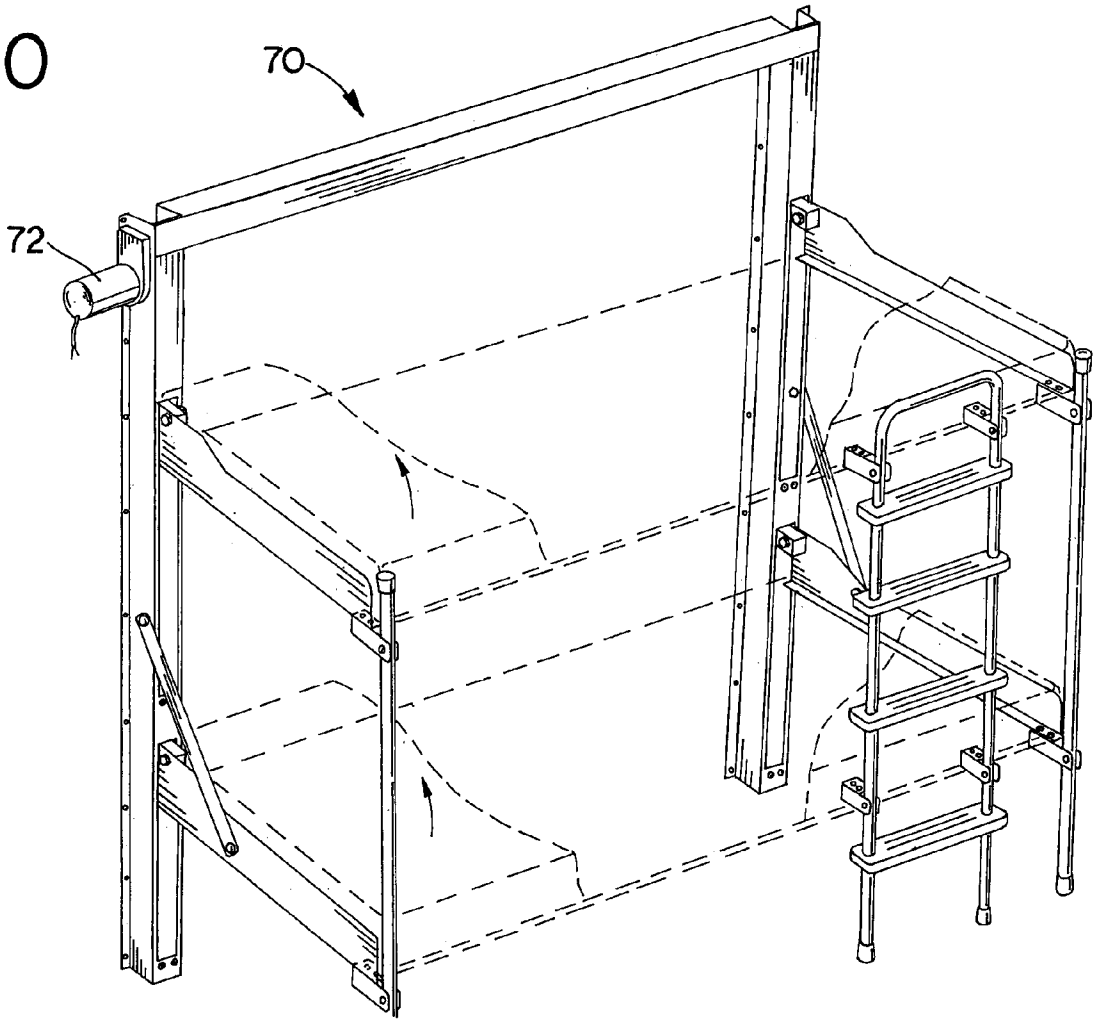
FIG. 10 is a perspective view of a third (powered) embodiment of the bunk bed of this invention with portions of the bed decks cut away.
Figure 11:
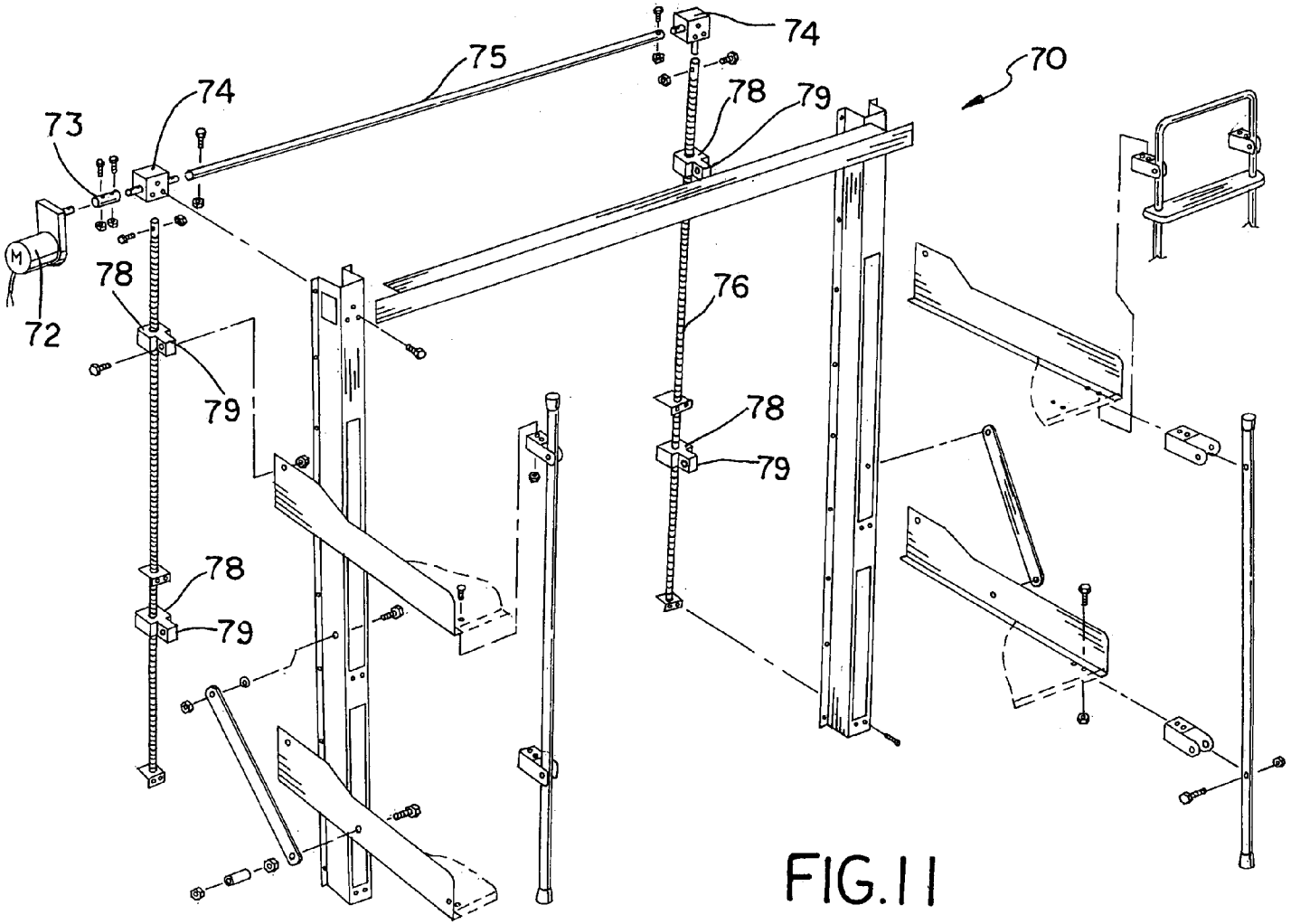
FIG. 11 is an exploded view of the third embodiment of the bunk bed.
Figure 12:
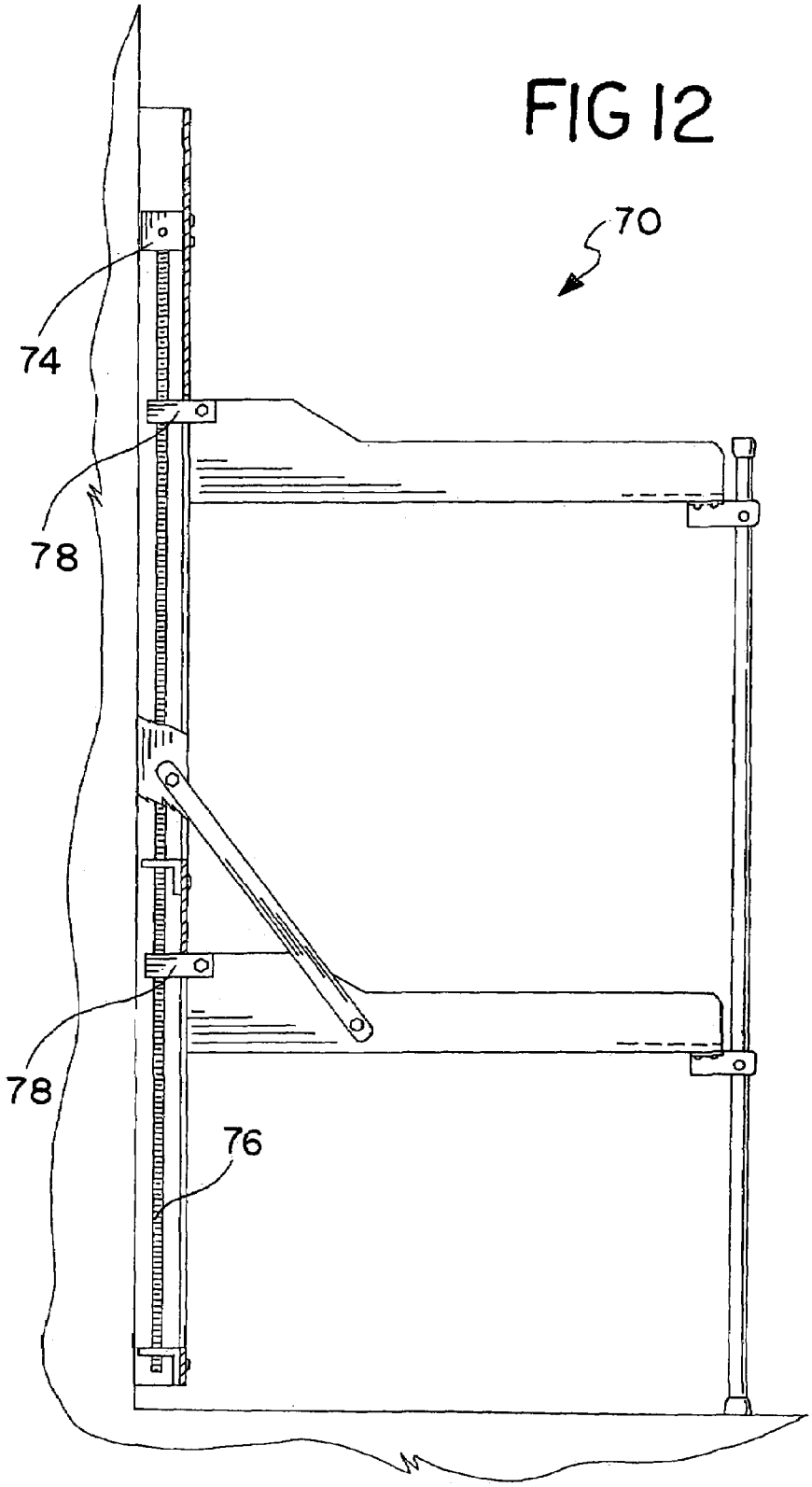
FIG. 12 is a side plan view of the third embodiment of the bunk bed in the horizontal sleep position.
Figure 13:
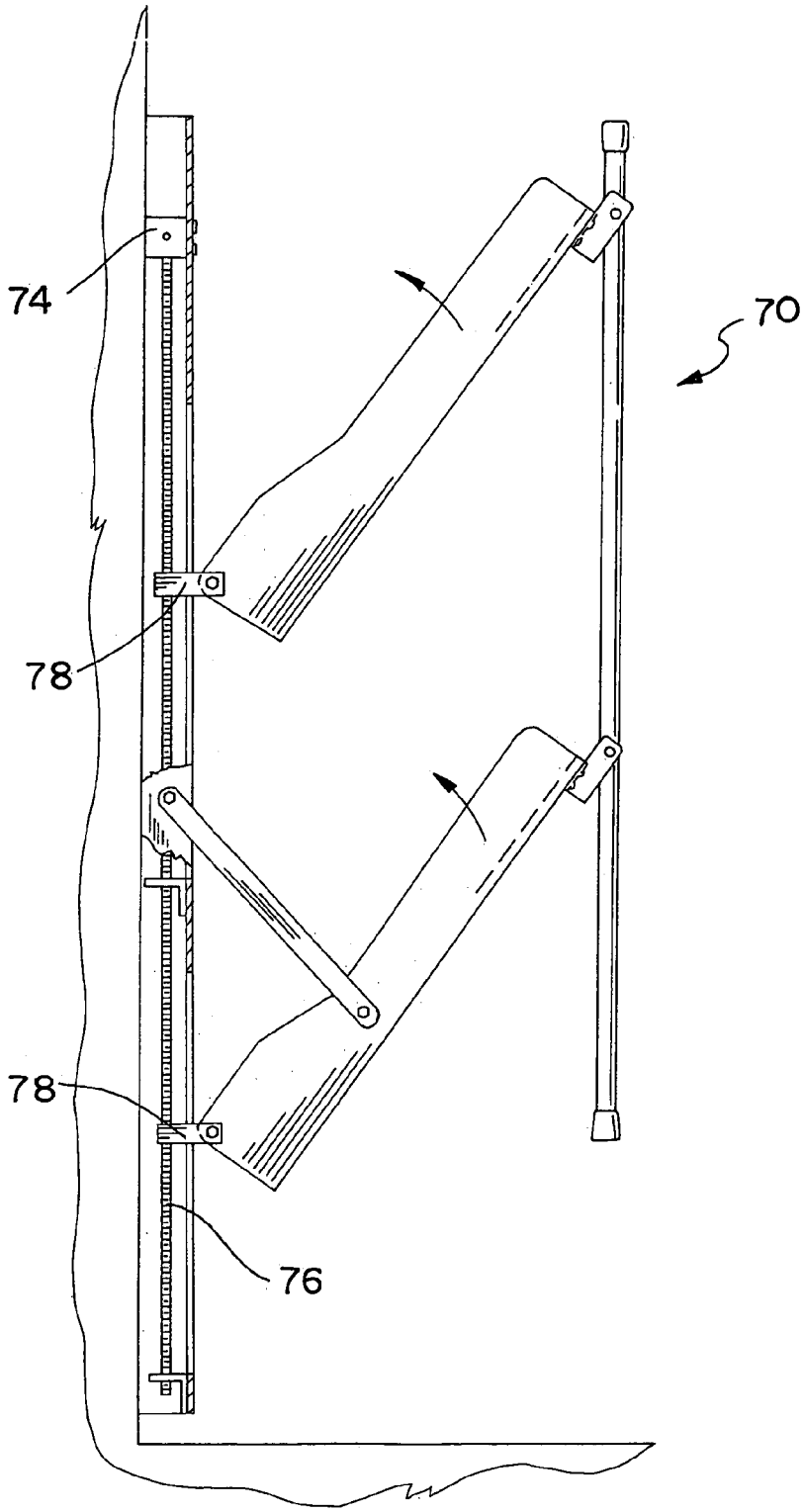
FIG. 13 is a side plan view of the third embodiment of the bunk bed pivoting from the horizontal sleep position to the vertical storage position.

FIGS. 8 and 9 illustrate a second embodiment of the manually folding bunk bed of this invention, which is designated generally as numeral 60. Bunk bed 60 is similar in construction and operation to bunk bed 10 above, except that the lower bed deck 62 is significantly larger and folds to overlie the upper bed deck 64. As shown, the lower deck support arm 66 has a greater depth, which spaces the deck further from the wall frame to allow the lower deck to overlie the upper deck. Bunk bed 60 also includes separate bed posts 68 to connect the bed decks and post feet 69 to support the decks.

Third Embodiment—Power Folding Bunk Bed with Linkage

FIGS. 10–14 illustrate a third embodiment of the folding bunk bed assembly of this invention, which is designated generally as reference numeral 10. Bunk bed 70 is a powered version of the first embodiment of the folding bunk bed of this invention. Bunk bed 70 is substantially similar to bunk bed 10 in design, construction and operation, except that it includes a powered actuation mechanism supported and enclosed within the wall frame. The powered actuation mechanism eliminates the carriage so that the bed decks are hinged directly to bearing blocks that travel along a pair of screw shafts. Again, a linkage is connected between the support arms of one bed deck and the upright of the wall frame and bed posts are used to support the bed decks in the sleep position.

The actuation mechanism includes an electric motor 72, a coupler 73, two gear boxes 74, a drive axle 75, a pair of screw shafts 76 and two pairs of bearing blocks 78. Ideally, motor 72 is a conventional reversible AC electric motor, although any suitable reversible motor can be employed. Typically, an electrical switch or electronic control (not shown) is connected to motor 72, which controls and selectively reverses the motor to operate bunk bed 10. The switch or control can be mounted to the wall frame, mounted to an interior wall or used as part of a wireless remote control system as desired. Such electric switches and electronic controls are well known in the arts.

Figure 14:
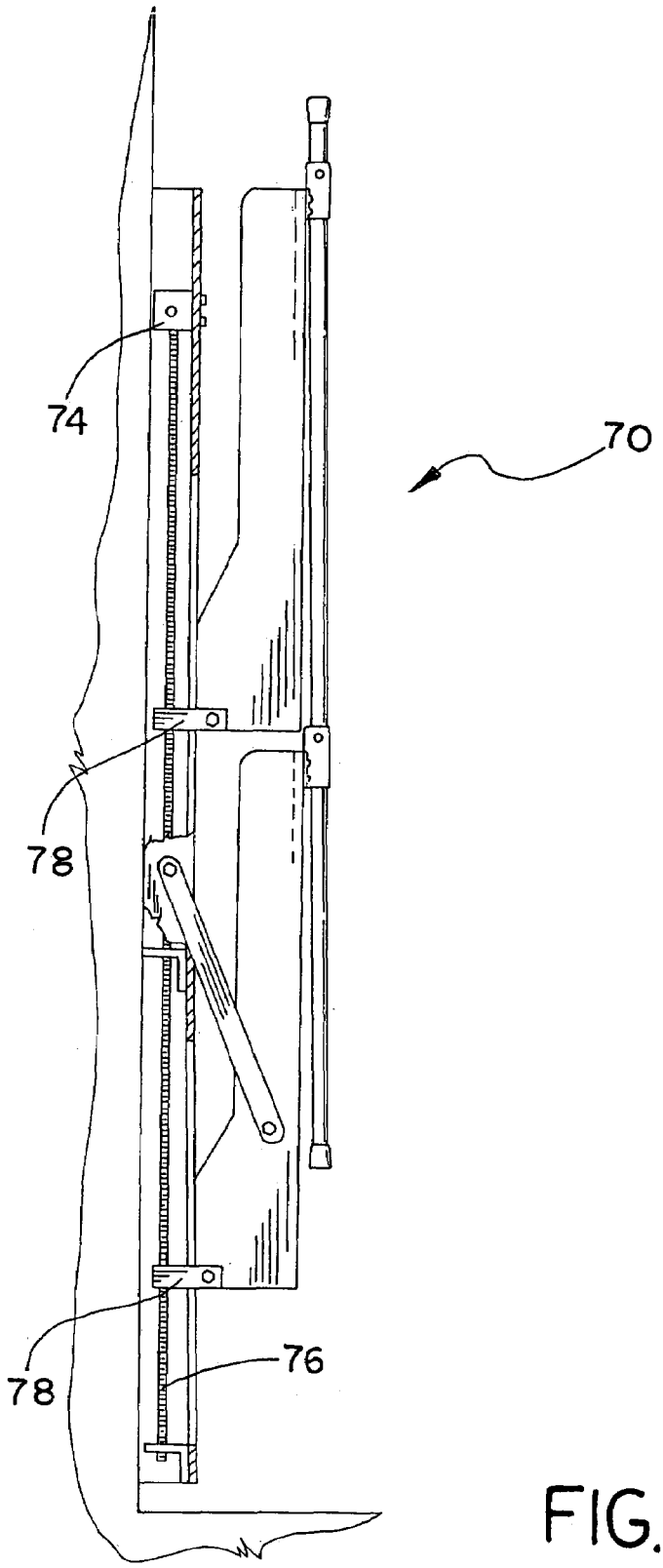
FIG. 14 is a side plan view of the third embodiment of the bunk bed in the vertical storage position.
Figure 15:
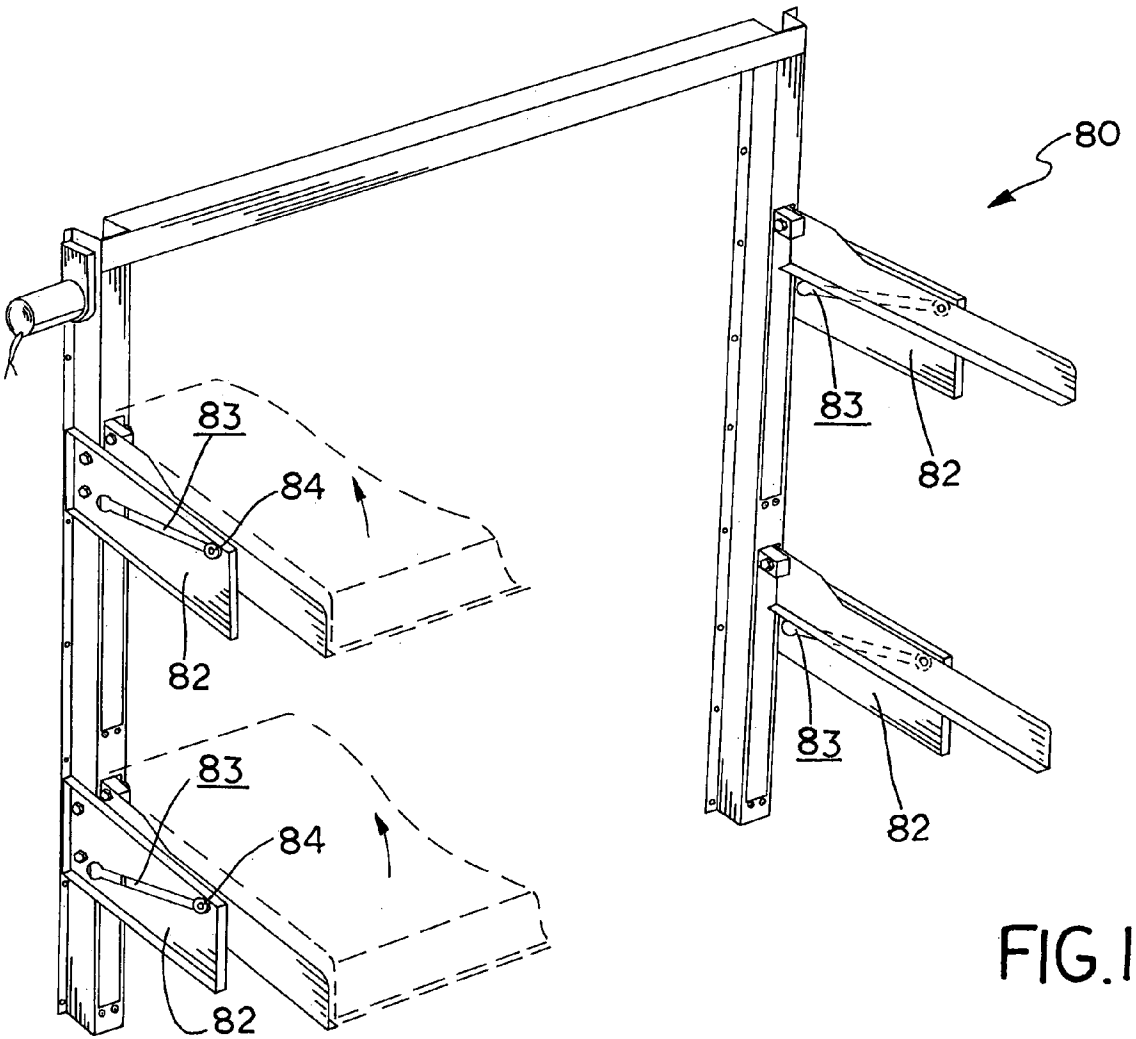
FIG. 15 is a perspective view of a fourth (powered) embodiment of the bunk bed of this invention with portions of the bed decks cut away.
Figure 16:
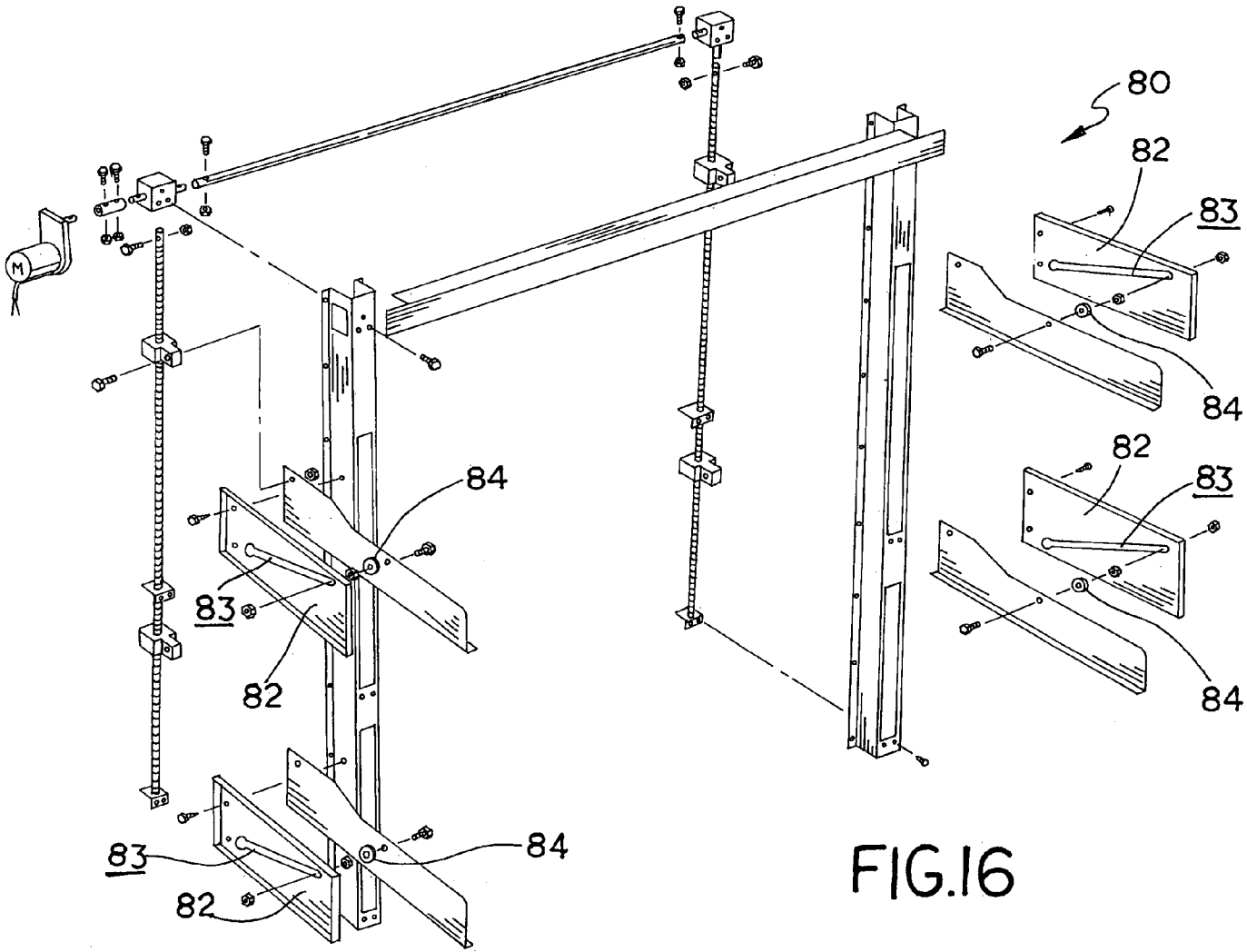
FIG. 16 is an exploded view of the fourth embodiment of the bunk bed.
Figure 17:
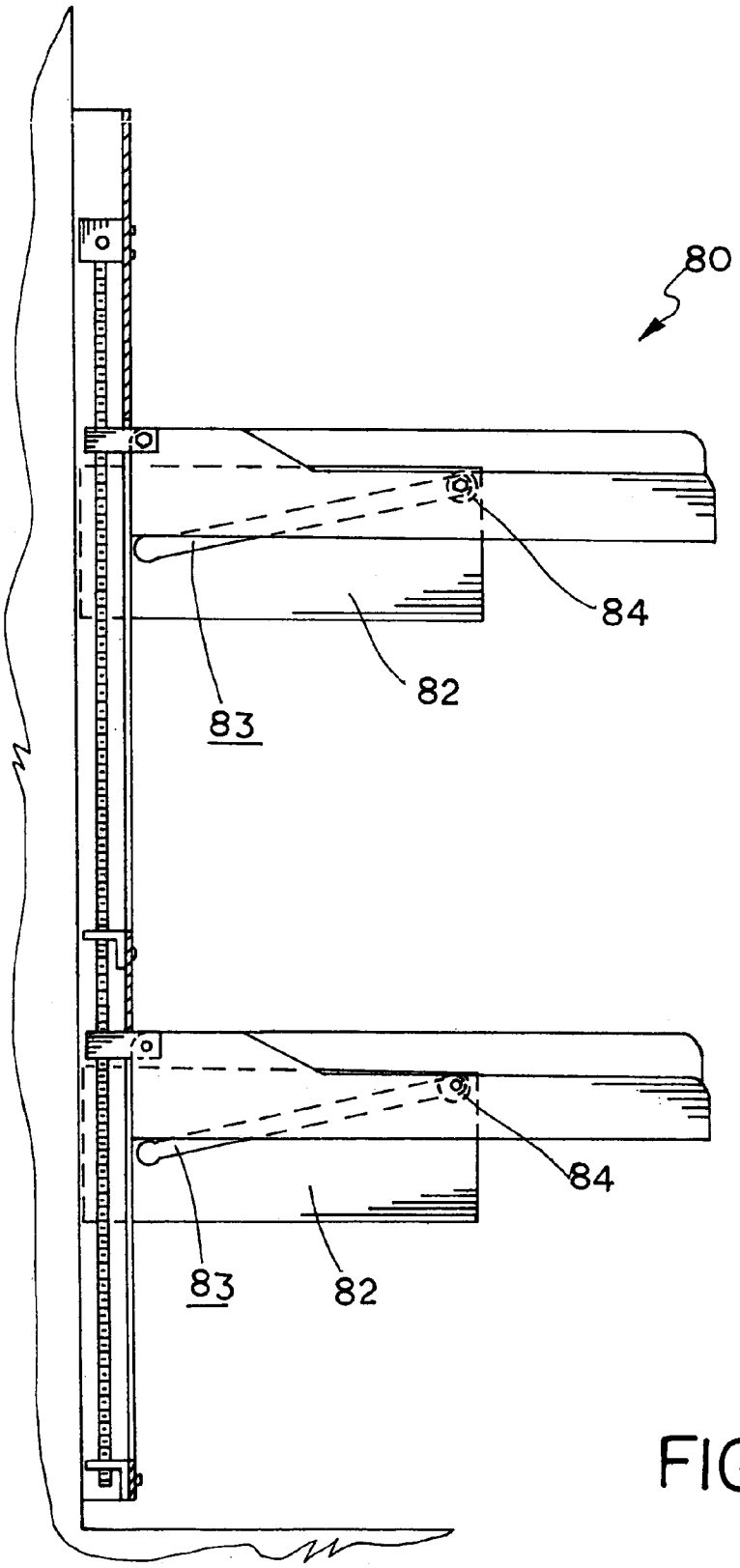
FIG. 17 is a side plan view of the fourth embodiment of the bunk bed in the horizontal sleep position.
Figure 18:
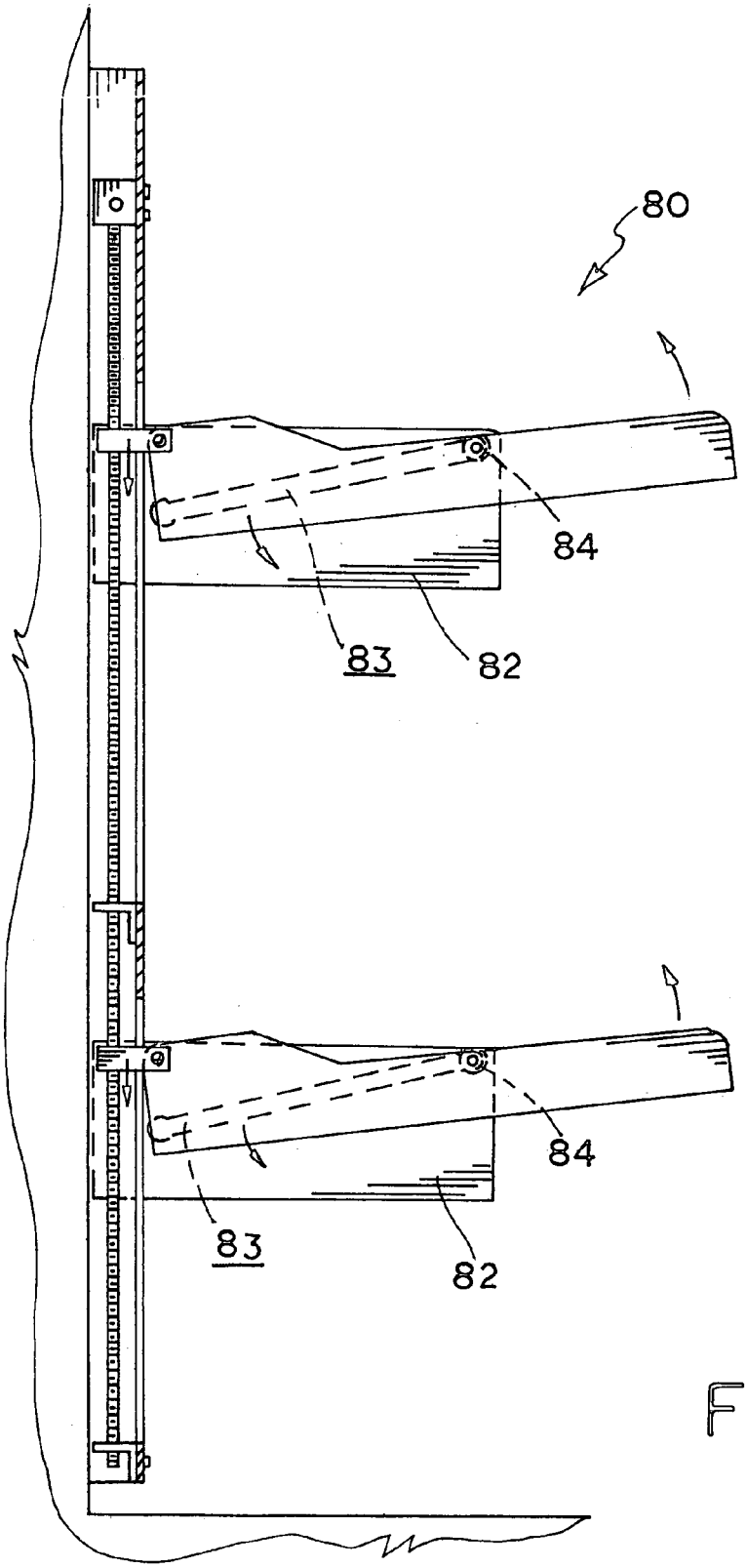
FIG. 18 is a side plan view of the fourth embodiment of the bunk bed pivoting from the horizontal sleep position to the vertical storage position.
Figure 19:
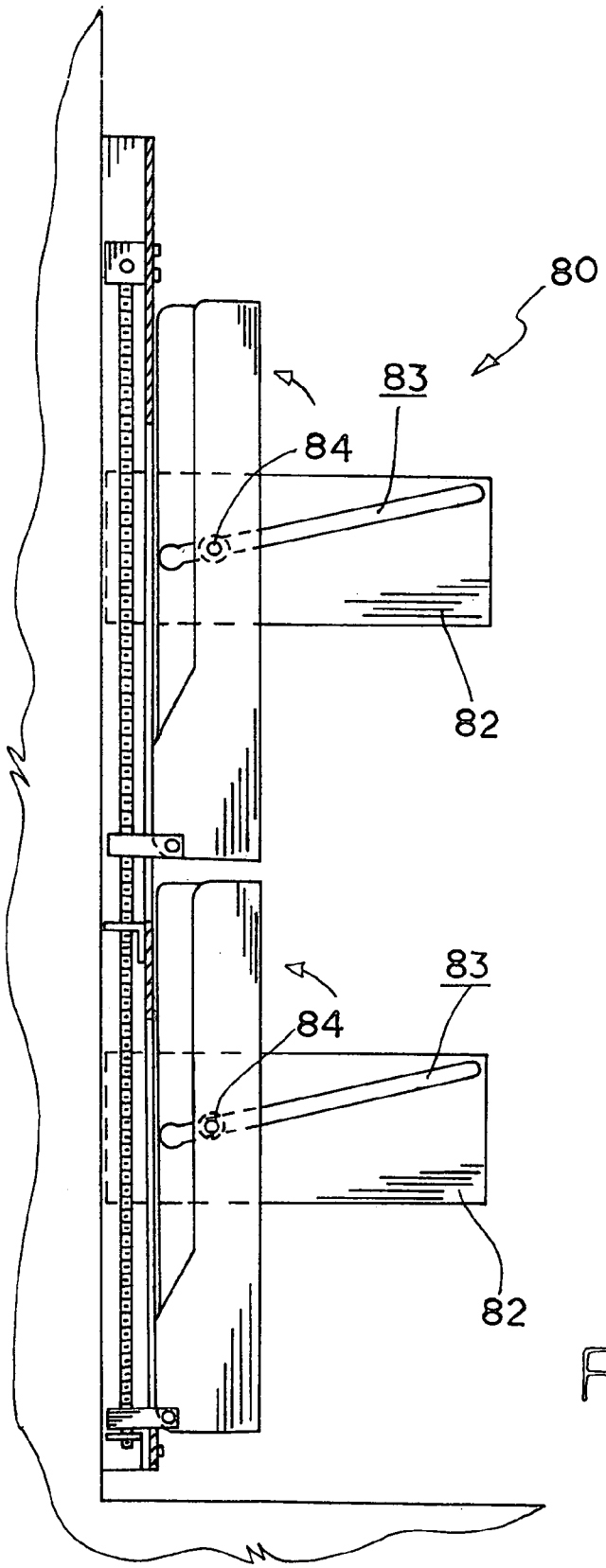
FIG. 19 is a side plan view of the fourth embodiment of the bunk bed in the vertical storage position.
Figure 20:
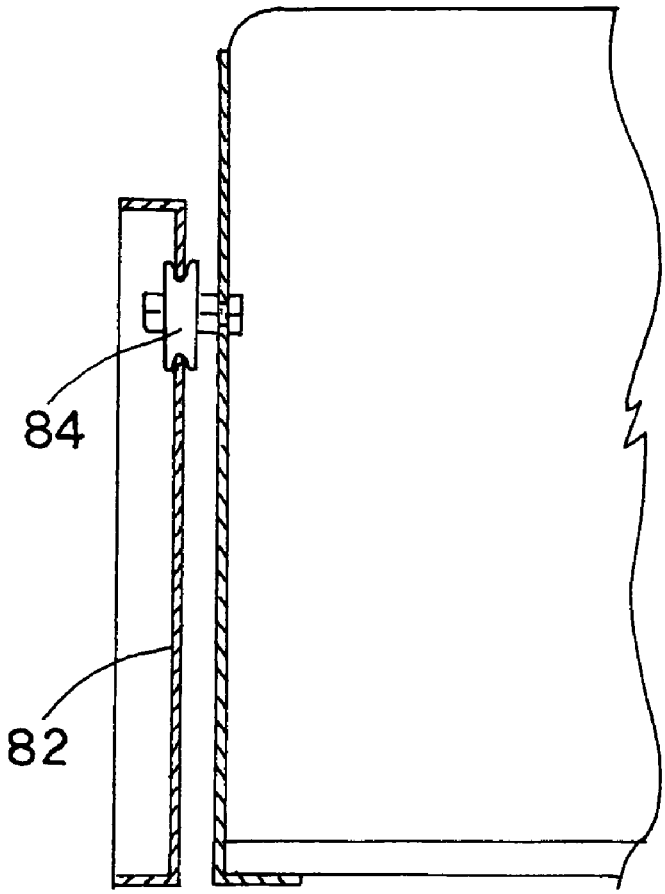
FIG. 20 is a front sectional view of the fourth embodiment of the bunk bed showing the track arm and support arm showing the roller seated within the slot of the track arm.

As shown, motor 72 is secured to the outside of the wall frame at the upper end of one of the uprights. Exteriorly mounting motor 72 to the wall frame allows for greater installation flexibility. Motor 72 is operably connected to gear boxes 74 by a coupler 73. Screw shafts 76 are disposed longitudinally within the uprights and are operably connected to gear boxes 74. Each screw shaft 36 carries a pair of spaced (upper and lower) bearing blocks 78, which traverse up and down the screw shafts when the shaft is turned. Each bearing block 78 has a threaded through bore through which screw shaft 76 is turned and a tab 79, which protrudes slightly from one of the two slots in the uprights. Because both bearing blocks are carried onto the same threaded screw shafts, the bearing blocks move in unison with the rotation of the screw shaft, which eliminates the need for the carriage structure of bunk beds 10 and 60. The rotation of screw shafts 76 reciprocates bearing blocks 78 up and down the screw shaft, which pivots the bed decks between the sleep position (FIG. 12) and the storage position (FIG. 14). Reversing motor 72 controls the operation of bunk beds 10.

Fourth Embodiment—Powered Folding Bunk Bed with Guide Tracks

FIGS. 15–20 illustrate a fourth embodiment of the bunk bed of this invention, which is designated generally as numeral 80. Bunk bed 80 is another powered folding bun bed that is similar in construction and operation to bunk bed 70 above, except that the linkage and leg posts are replaced by two pairs of horizontal track arms 82. As shown, each upper and lower track arm 82 extends cantilevered from the uprights and has an angled slot 83. The deck support arms include a roller 84 mounted to their side. As shown best in FIG. 20, rollers 84 are seated within slot 83, which acts as a guide track. When the bearing blocks traverse along the screw shafts between the ends of the upright slots, rollers 84 move along slots 83 to pivot the bed decks between the sleep and storage positions.

Advantages

One skilled in the art will note several advantages of the bunk beds of this invention over the prior art. The vertically shifting pivot point allows the bed decks to kneel down, that is to fold up at a pivot point lower on the wall. The shifting pivot point not only accommodates larger bed decks and eliminates the problems associated with cable supports, but allows bed decks to overlap in the storage position. Bunk beds of this invention are designed so that the depth of the support arms allows the mattress and bedding of each bunk to be folded with the bed deck for convenient storage. The depth of the support arm can also be increased so that the lower bed decks will overlap the upper deck in the storage position. With the lower deck overlapping and covering the upper deck in the storage position, the size of the lower bed deck is limited only by ceiling height.

The pivot point of the support arms, that is the location where the support arm is pivotally connected to the bearing blocks (the axis of bore), allows the bottom edge of the deck support arms to kick out as the carriage or bearing blocks begin to move down the shafts from the top of the upright slots, which is important to account for the mattress and bedding supported on bed decks and to prevent the bed decks from binding when folded into the storage position. Without the joggle in the support arms and locating the pivot point sufficiently above the bottom flange of the support arm, the bed decks would bind and not fold flat vertically between the wall frame.

Another advantage is that the screw shaft actuation mechanism is more reliable than the cable actuated mechanisms and does not require complex mechanical adjustments. Cable adjustment, tension and winding problems are eliminated by the use of screw shafts. In addition, the screw actuation mechanism can reliably produce more lifting power so that larger bed decks, mattresses and bedding can be employed. The actuation mechanism is enclosed entirely within the wall frame, which reduces unsightly cable and reduces possible safety hazards. The screw shafts, axles and gear boxes are enclosed within the wall frame, and the motor is mounted to the exterior of the wall frame for convenient service and replacement.

While directed at folding bunk bed applications, the teaching of this invention can be expanded to folding counter top applications, as well. The bed decks can be fashioned to double as a counter top or table, as required. The bunk beds of this invention have a simple design and fold flat against the interior wall to maximize living space. In addition, the automated actuation mechanism of this invention can be applied to folding counter tops, as well as bed decks.

It is understood that the above description does not limit the invention to the details given, but may be modified within the scope of the following claims.

I claim:

1. A folding bunk bed mounted to a vertical wall comprising:

an upright mountable to the vertical wall and having an elongated interior defined therein;

a vertical shaft mounted longitudinally within the upright interior, a carriage mounted to the shaft for reciprocal movement along the length of the shaft within the upright interior;

a first deck pivotally connected to the carriage;

a second deck pivotally connected to the carriage and spaced below the first deck; and a linkage pivotally connected between the upright and one of the first deck and second deck such that the first deck and second deck pivot simultaneously between a substantially horizontal sleep position and a vertical storage position as the carriage moves along the length of the shaft.

2. The folding bunk bed of claim 1 and a leg pivotally connecting the first deck and the second deck.

3. The folding bunk bed of claim 1 wherein the upright also having a longitudinal slot therein.

4. The folding bunk bed of claim 3 wherein the first deck includes a support arm pivotal to the carriage and extending outward from the upright through the upright slot.

5. The folding bunk bed of claim 4 wherein the linkage is connected between the support arm and the upright.

6. The folding bunk bed of claim 1 and a leg pivotally connecting the first deck and the second deck.

7. The folding bunk bed of claim 1 and means for actuating the first deck and second deck between the horizontal sleep position and the vertical storage position.

8. The folding bunk bed of claim 7 wherein the actuating means includes a motor for rotating the shaft.

9. The folding bunk bed of claim 8 wherein the shaft having screw threads, the carriage includes a bearing block operatively riding on the shaft.

10. The folding bunk bed of claim 8 wherein the shaft having screw threads, the carriage includes a bearing block operatively riding on the shaft.

11. The folding bunk bed of claim 7 wherein the actuating means includes a motor for rotating the shaft.

12. The folding bunk bed of claim 1 and means for actuating the first deck and second deck between the horizontal sleep position and the vertical storage position.

13. A folding bunk bed mounted to a vertical wall comprising:

a frame mountable to the vertical wall;

a first track arm and a second track arm extending outward from the frame, each of the first track arm and the second track arm having an elongated slot;

a vertical shaft mounted to the frame, a carriage mounted to the shaft for reciprocal movement along the length of the shaft;

a first deck pivotally connected to the carriage;

a second deck pivotally connected to the carriage and spaced below the first deck;

the first deck having a roller shiftably disposed within the slot of the first track arm and the second deck having a roller shiftably disposed within the slot of the second track arm such that the first deck and second deck pivot simultaneously between a substantially horizontal sleep position and a vertical storage position as the carriage moves along the length of the shaft.

14. The folding bunk bed of claim 13 wherein the frame includes an upright having an elongated interior defined therein, the shaft disposed longitudinally within the upright interior, the carriage shiftably disposed within the upright interior.

15. The folding bunk bed of claim 14 wherein the upright also having a longitudinal slot therein.

16. The folding bunk bed of claim 13 and means for actuating the first deck and second deck between the horizontal sleep position and the vertical storage position.

17. The folding bunk bed of claim 16 wherein the actuating means includes a motor for rotating the shaft.

18. The folding bunk bed of claim 17 wherein the shaft having screw threads, the carriage includes a bearing block operatively riding on the shaft.

19. A folding bunk bed mounted to a vertical wall comprising:

a frame mountable to the vertical wall, the frame includes an upright having an elongated interior defined therein and a longitudinal slot therein;

a vertical shaft mounted to the frame, the shaft disposed longitudinally within the upright interior;

a carriage mounted to the shaft for reciprocal movement along the length of the shaft, the carriage shiftably disposed within the upright interior;

a first deck pivotally connected to the carriage, the first deck includes a support arm pivotal to the carriage and extending outward from the upright through the upright slot;

a second deck pivotally connected to the carriage and spaced below the first deck; and a linkage pivotally connected between the frame and one of the first deck and second deck such that the first deck and second deck pivot simultaneously between a substantially horizontal sleep position and a vertical storage position as the carriage moves along the length of the shaft.

20. The folding bunk bed of claim 19 wherein the linkage is connected between the support arm and the upright.

* * * * *